US007205491B2

(12) United States Patent
Kaizu et al.

(10) Patent No.: US 7,205,491 B2
(45) Date of Patent: Apr. 17, 2007

(54) MEMBRANE FOR KEY SWITCH AND THE KEY SWITCH

(75) Inventors: Masahiro Kaizu, Chiba (JP); Tadanori Ominato, Chiba (JP); Koji Hirai, Chiba (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 10/527,399

(22) PCT Filed: Sep. 11, 2003

(86) PCT No.: PCT/JP03/11651

§ 371 (c)(1),
(2), (4) Date: Apr. 6, 2005

(87) PCT Pub. No.: WO2004/025677

PCT Pub. Date: Mar. 25, 2004

(65) Prior Publication Data

US 2006/0016679 A1 Jan. 26, 2006

(30) Foreign Application Priority Data

Sep. 11, 2002 (JP) ..... 2002-265932
Apr. 15, 2003 (JP) ..... 2003-110337

(51) Int. Cl.
*H01H 9/26* (2006.01)

(52) U.S. Cl. ..... 200/5 A; 200/520

(58) Field of Classification Search ..... 200/5 A, 200/5 R, 406, 16 R–16 D, 275, 510–517
See application file for complete search history.

(56) References Cited

U.S. PATENT DOCUMENTS 2,706,226 A * 4/1955 Welsh ..... 337/136
4,195,210 A * 3/1980 Pounds et al. ..... 200/516
6,563,488 B1 * 5/2003 Rogers et al. ..... 345/163
6,603,086 B2 * 8/2003 Kawaguchi et al. ..... 200/517
6,683,265 B2 * 1/2004 Masuda ..... 200/406
6,700,085 B2 * 3/2004 Teruyama et al. ..... 200/406
6,951,991 B2 * 10/2005 Asada et al. ..... 200/406
2002/0092753 A1 * 7/2002 Asada ..... 200/406
2005/0236264 A1 * 10/2005 Asada ..... 200/406

FOREIGN PATENT DOCUMENTS

JP S62-175535 U 11/1987
JP H03-091629 U 9/1991
JP H05-190053 A 7/1993
JP H09-092079 A 4/1997
JP 2001-216865 A 8/2001
JP 2002-216580 A 8/2002

* cited by examiner

*Primary Examiner*—Michael A. Friedhofer
*Assistant Examiner*—Lisa Klaus
(74) *Attorney, Agent, or Firm*—Sughrue Mion, PLLC

(57) ABSTRACT

The present invention provides a key switch diaphragm capable of obtaining a good click feeling and capable of avoiding contact failure and having a high durability. A key switch diaphragm 30 comprises a thin plate having flexibility and conductivity, and the key switch diaphragm 30 includes a truncated pedestal 16, and a spherical domical portion 18 being raised toward an upper portion of the pedestal 16 on the side of the upper portion of the pedestal 16. The domical portion 18 is provided at its substantially central portion with an outwardly raised portion 32 being raised toward an outer surface of the domical portion 18. An edge of the outwardly raised portion 32 on the side of its inner surface forms a contact 34.

8 Claims, 10 Drawing Sheets

PRIOR ART

MEMBRANE FOR KEY SWITCH AND THE KEY SWITCH

TECHNICAL FIELD

The present invention relates to a key switch (flat switch) having a conical pedestal and a spherical domical portion on an upper end of the pedestal, and the invention also relates to a key switch.

BACKGROUND ART

FIGS. 1A and 1B show an outline structure of a first conventional key switch 100. FIG. 1A is a plan view of the key switch 100, and FIG. 1B is a sectional view taken along the line IB—IB in FIG. 1A. FIG. 2 is a diagram showing a state where the key switch 100 is pressed. For example, the conventional key switch 100 used for a push button of a portable phone includes a base plate 6 provided with an annular wiring pattern 2, and with a wiring pattern 4 which is disposed on substantially a central portion of the wiring pattern 2 and which is separated from the wiring pattern 2. The key switch 100 also includes a key switch diaphragm 102 which is curved in a direction in which the central portion is separated away from the base plate 6 and which is disposed on the base plate 6, and a cover film 10 covering the key switch diaphragm 102 and the base plate 6. When the key switch 100 is used for the cellular phone and the like, the key switch 100 is generally required to have a durability to withstand million times presses.

One of surface (surface on the side of the base plate 6) of the cover film 10 that is in contact with the base plate 6 and the key switch diaphragm 102 has adherence. Thus, the key switch diaphragm 102 is not displaced in a direction along the surface of the base plate 6.

The edge of the key switch diaphragm 102 forms a contact 12. In a state where the key switch diaphragm 102 is placed on the base plate 6, the contact 12 and the wiring pattern 2 formed on the base plate 6 are electrically contacted with each other.

As shown in FIG. 2, a central portion of the key switch diaphragm 102 is pressed toward the base plate 6, the central portion of the key switch diaphragm 102 is dented toward the base plate 6, a contact 104 of the key switch diaphragm 102 formed in a recessed side of the central portion and the wiring pattern 4 formed on the base plate 6 are electrically connected to each other, and the wiring pattern 2 and the wiring pattern 4 are electrically connected to each other.

The key switch diaphragm 102 is formed by working or machining a metal thin plate having flexibility and conductivity. The key switch diaphragm 102 has a truncated pedestal 16 having appropriate height, and a spherical domical portion 18 being raised toward an upper portion of the pedestal 16 on the side of the upper portion of the pedestal 16 (constricted side of the pedestal).

When the key switch 100 is pressed, the pedestal 16 of the key switch diaphragm 102 is not deformed almost at all, and the domical portion 18 is mainly elastically deformed until the contact 104 and the wiring pattern 4 of the base plate 6 come into electric contact with each other. Thus, as compared with a case where there is no pedestal 16, greater pressing stroke and greater pressing force can be secured and with this structure, a good click feeling can be obtained.

When the key switch 100 is pressed toward the base plate 6 or this pressing is released as shown in FIG. 2, the volume of space surrounded by the base plate 6 and the key switch diaphragm 102 is changed. In order to change the air pressure in the space, a through hole 20 is formed in the cover film 10 in the vicinity of the edge of the key switch diaphragm 102. Since air passes through the through hole 20, the air pressure in the space when the key switch 100 is pressed or the pressing is released is maintained substantially constantly.

DISCLOSURE OF THE INVENTION

When dust such as glass floss enters the space surrounded by the key switch diaphragm 102 and the base plate 6, however, even if the key switch 100 is pressed, the wiring pattern 4 of the base plate 6 and the contact 104 of the key switch diaphragm 102 cannot contact with each other due to the glass floss. There is also a problem that a switching malfunction occurs due to contact failure of the key switch 100 in some cases.

To avoid this problem, as shown in FIGS. 3(A) and 3(B), it is conceived to form a key switch 200 or a key switch 300 using a key switch diaphragm 102A or a key switch diaphragm 102C in which the central portion is provided with a raised portion 102B.

FIG. 3(A) is a sectional view of a second conventional key switch 200. The key switch diaphragm 102A of the key switch 200 is provided at its substantially central portion with the raised portion 102B being raised toward the recessed side. When the key switch 200 is pressed, the contact 104A and the wiring pattern 4 of the base plate 6 electrically contact with each other.

FIG. 3(B) is a sectional view of a third conventional key switch 300. The key switch diaphragm 102C of the key switch 300 is provided at its substantially central portion with a plurality of (three in this example) raised portions 102B being raised toward the recessed side. When the key switch 300 is pressed, at least one of the contacts 104A and the wiring pattern 4 of the base plate 6 electrically contact with each other.

In the case of the key switch 200, an area of the contact 104A which contacts with the wiring pattern 4 of the base plate 6 is smaller than that of the contact 104 of the key switch 100. Thus, even if dust such as glass floss enters the surrounded space, the contact failure of the key switch 200 is less likely to occur as compared with the key switch 100.

The key switch 300 includes the plurality of contacts 104. When the key switch 300 is pressed, if at least one of the contacts comes into contact with the wiring pattern 4 of the base plate 6, the contact failure of the key switch can be avoided. Thus, the contact failure is further less likely to occur as compared with the key switch 200.

When the dust which enters the surrounded space is glass floss or other fiber, however, since the raised portion 102B pushes the dust away, the contact failure which is caused when the key switch 200 or key switch 300 is pressed is avoided, but when the dust is material which is prone to adhere such as adhesive droplets or resin droplets and such dust adheres to the contact 104A of the key switch diaphragms 102A, 102C, there is a problem that the contact failure is likely to occur.

Furthermore, in the case of the key switch diaphragm 102A of the key switch 200 or the key switch diaphragm 102C of the key switch 300, the raised portion 102B is formed on the recessed side (on the side of the base plate 6 or pedestal 16) of the central portion (pressed portion). Therefore, a distance between the contact 104A formed on the tip end side of the raised portion 102B and the wiring pattern 4 of the base plate 6 becomes shorter than the key switch 100 when the switch is not operated (in a state in which the key switch 200 or key switch 300 is not pressed as shown in FIGS. 3(A) and 3(B). Therefore, in the case of the key switch 200 or 300, the pressing stroke becomes smaller than that of the key switch 100, and a good click feeling cannot be obtained.

To secure the pressing stroke, it is conceived that the height of the pedestal 16 is increased. However, if the key switch diaphragm 102A of the key switch 200 or the key switch diaphragm 102C of the key switch 300 is molded using press such that the height of the pedestal 16 is increased, the key switch diaphragm 102A or the key switch diaphragm 102C must largely be plastically deformed especially at the pedestal 16, and a large residual stress is generated in the key switch diaphragm 102A or 102C. Whenever the operation that the key switch 200 or key switch 300 is pressed and the pressing is released is repeated, the key switch diaphragm 102A or key switch diaphragm 102C are elastically deformed, the repeated load generated by this elastic deformation is added to the residual stress and the large stress is generated, and there is a problem that the key switch diaphragm 102A or key switch diaphragm 102C is prone to become fatigued and broken, and the durability is deteriorated.

In the case of the key switch 300, since the key switch diaphragm 102C includes the plurality of raised portions 102B, the contact failure is less likely to occur as compared with the key switch 200, but when the key switch 300 is pressed, if one of the contacts 104A of the key switch diaphragm 102C comes into contact with the wiring pattern 4 of the base plate 6, since the one contact is decentered from the key switch diaphragm 102C, a stress maldistributed in the key switch diaphragm 102C is generated, and the durability is more deteriorated than the key switch 200 in some cases.

FIG. 3(C) is a sectional view of a fourth conventional key switch 400. A key switch diaphragm 102D of the key switch 400 is provided at its substantially central portion with a through hole 102E instead of the raised portion 102B.

When the key switch 400 is pressed, the edge portion of the base plate 6 on the side of the outer peripheral edge forms a contact 104B, and this contact 104B and the wiring pattern 4 of the base plate 6 are brought into contact with each other and are electrically connected. In the key switch 400, the edge of the through hole 102E formed in substantially central portion of the key switch diaphragm 102D forms the contact 104B. Thus, when the key switch 400 is pressed, even if dust exists in the surrounded space, the contact 104B easily contacts with the wiring pattern 4 of the base plate 6, and the contact failure can be avoided. Since there exists no raised portion on the recessed side of the key switch diaphragm 102D, the pressing stroke can be ensured, and a good click feeling can be obtained, without increasing the height of the truncated pedestal 16.

However, when the key switch 400 is pressed, the key switch diaphragm 102D is elastically deformed, stresses are concentrated on the outer peripheral edge of the through hole 102E, and there is a problem that cracks are generated from the outer peripheral edge of the through hole 102E toward the outer periphery of the key switch diaphragm 102D in some cases, and the durability of the of the key switch 400 is deteriorated in some cases.

When the key switch 400 is pressed, since there exists the through hole 102E, an adhesive portion of a cover film 10 is transferred to the wiring pattern 4 of the base plate 6, and there is a problem that the contact failure occurs in the key switch 400.

It is conceived that a cover film having no adherence is used in a portion corresponding to the through hole 102E. However, it is troublesome to produced such a cover film, and it is difficult to assemble a key switch such that a non-adhesive portion and the through hole 102E are aligned with each other in position.

As shown in FIG. 1B, the key switch 100 comprising the key switch diaphragm 102 includes a press member (actuator) AC1 for pressing the key switch diaphragm 102. The actuator AC1 is integrally formed together with a sheet-like elastic support member (such as silicon rubber sheet) (not shown) which is disposed on a front surface of the key switch 100. The actuator AC1 is laminated on the base plate 6 of the key switch and the key switch diaphragm 102 together with the silicon rubber sheet, and is disposed on the key switch 100. When the actuator AC1 is disposed, it is disposed such that the center CL12 of the actuator AC1 is deviated from the center CL10 of the key switch diaphragm 102 by $\Delta L3$ in some cases.

If the actuator AC1 is deviated in this manner, in the case of the conventional key switch 100 using the key switch diaphragm 102, a later-described click rate (one of indices for objectively showing the quality of the click feeling by means of numerical value) is lowered in substantially proportion to the deviation amount. That is, there is a problem that the click feeling is deteriorated by the deviation amount. This problem occurring with the deviation amount also happens in the other key switches 200, 300, and 400.

The present invention has been achieved in view of the above problems, and the present invention provides a key switch diaphragm and a key switch having a high durability and capable of obtaining a good click feeling when the switch is pressed, and capable of avoiding generation of contact failure.

A first technical aspect of the present invention provides a key switch diaphragm comprising, a first leaf spring having conductivity and having a base fixed in position with respect to a reference surface and a plate portion being raised in a direction away from the reference surface, and a second leaf spring having conductivity and formed on a central portion of the plate portion raised in a direction away from the reference surface, wherein when an external force acting toward the reference surface is applied to the second leaf spring, an edge of the central portion comes into contact with the reference surface.

According to a second technical aspect of the invention, the diaphragm further comprises at least one raised portion being raised toward the reference surface, wherein when an external force acting toward the reference surface is applied to the second leaf spring, at least the raised portion comes into contact with the reference surface.

A third aspect of the invention provides the key switch diaphragm according to the first aspect, wherein the diaphragm further comprises a third leaf spring formed on the second leaf spring raised in a direction away from the reference surface, and wherein when an external force acting toward the reference surface is applied to the third leaf spring, an edge of at least the third leaf spring comes into contact with the reference surface.

A fourth aspect of the invention provides the key switch diaphragm according to the first aspect, wherein the diaphragm further comprises an opening formed in the second leaf spring, and wherein when an external force acting toward the reference surface is applied to the second leaf spring, an edge of at least the opening comes into contact with the reference surface.

A fifth aspect of the invention provides the key switch diaphragm according to the second aspect, wherein the diaphragm further comprises the raised portion comprises three raised portion, the raised portions are disposed at equal distances from one another on the circumference of a circle formed around a center of the second leaf spring.

BEST MODE FOR CARRYING OUT THE INVENTION

First Embodiment

Figure 4A:
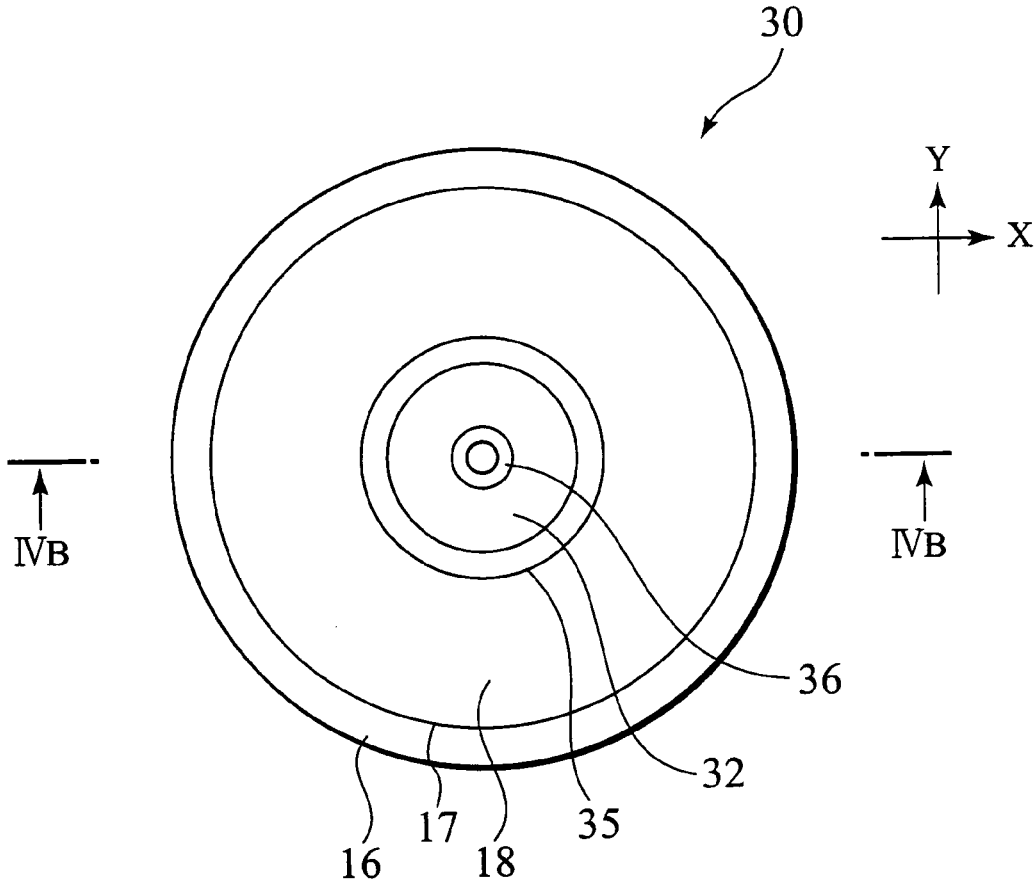
FIG. 4A is a schematic structure diagram of a key switch diaphragm constituting a key switch according to a first embodiment of the invention.
Figure 4B:
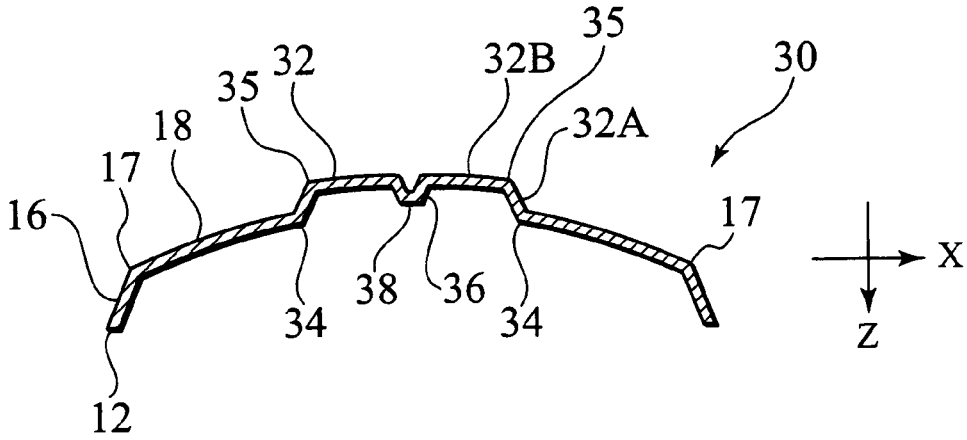
FIG. 4B is a sectional view taken along the line IVB—IVB in FIG. 4A.
Figure 5:
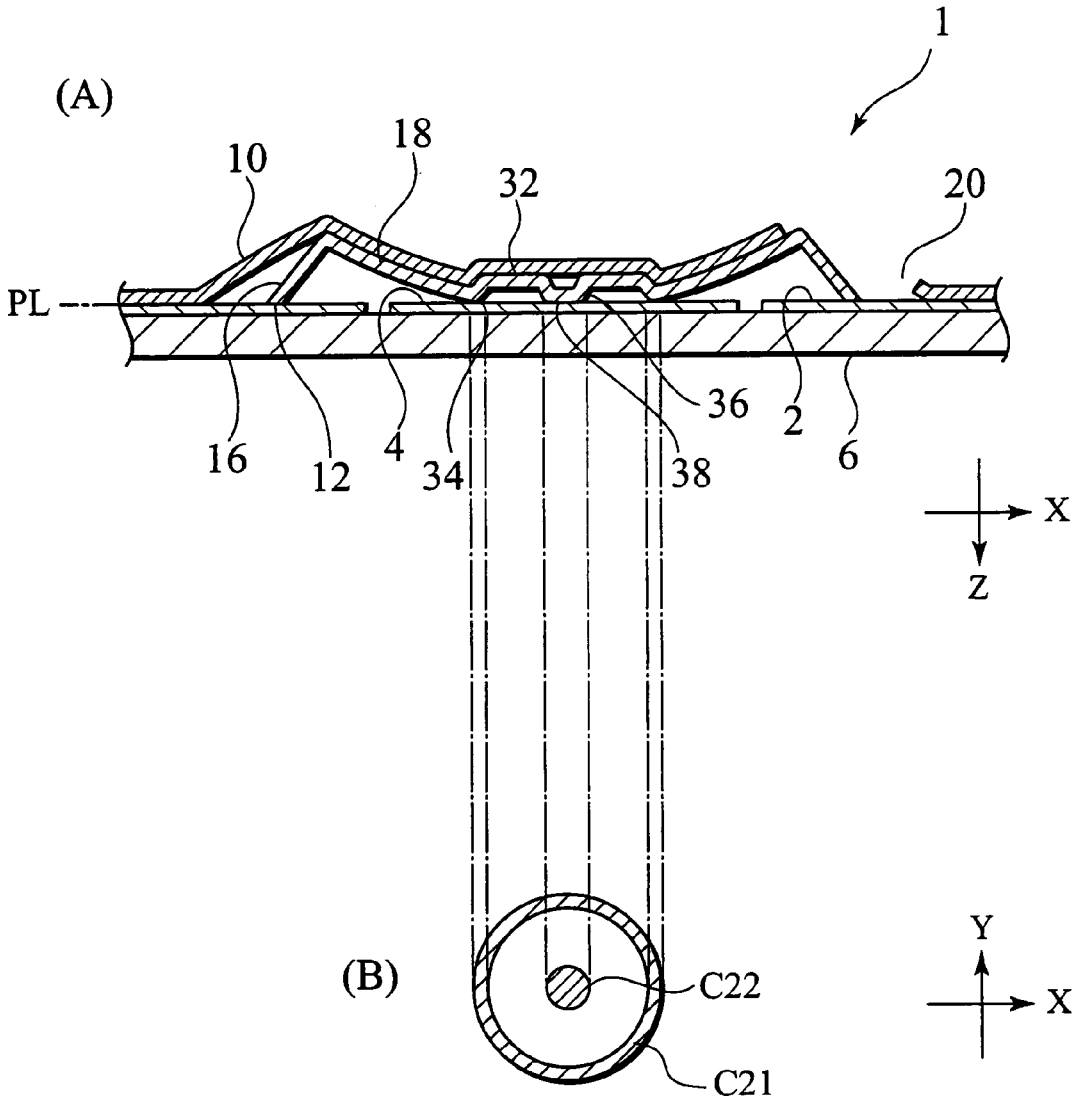
FIG. 5(A) is a diagram showing a state where a key switch constituted by the key switch diaphragm is pressed.
FIG. 5(B) is a diagram showing a contact surface pattern when the key switch shown in FIG. 5(A) is pressed.

FIGS. 4A and 4B show an outline structure of a key switch diaphragm 30 constituting a key switch 1 according to a first embodiment of the present invention. FIG. 4A is a plan view of the key switch diaphragm 30, FIG. 4B is a sectional view taken along the line IV B—IV B in FIG. 4A. FIG. 5 shows a state where the key switch 1 constituted by the key switch diaphragm 30 is pressed. In FIG. 4A, a base plate 6, a cover film 10 and a wiring pattern 2, 4 of the base plate 6 are omitted to facilitate understanding.

The key switch diaphragm 30 is integrally formed by pressing a thin plate (e.g., metal thin plate) having flexibility and conductivity. The key switch diaphragm 30 is formed such that the key switch diaphragm 30 is squeezed toward a substantially central portion of a spherical domical portion 18, and an outwardly raised portion 32 being raised toward an upper side (raised side) of the domical portion 18 is formed. That is, the key switch diaphragm 30 includes the spherical domical portion 18 raised in a direction (negative direction in an axial Z) where the domical portion 18 is separating away from a reference surface PL defined by the conductor pattern 2, on an upper side of a truncated pedestal 16. The key switch diaphragm 30 also includes the outwardly raised portion 32 being raised toward an outer surface side (raised side) in a direction separating away from the reference surface PL. The outwardly raised portion 32 is provided at substantially central portion of the domical portion 18. An edge of the domical portion 18 on the side of inner surface (recessed side) functions as a contact 34.

In other words, the key switch diaphragm 30 is made of thin plate having flexibility and conductivity. The key switch diaphragm 30 includes the truncated pedestal 16, and the spherical domical portion 18 being raised toward an upper portion of the pedestal 16 on the side of the upper portion (constricted side) of the pedestal 16. The key switch diaphragm 30 also includes the circular outwardly raised portion 32 being raised toward the outer surface (raised side; opposite side from the pedestal) of the domical portion 18. The outwardly raised portion 32 is located at substantially central portion of the domical portion 18. The edge (boundary portion between the outwardly raised portion 32 and the domical portion 18) of the inner surface side (pedestal side, recessed side of the domical portion 18) forms the contact 34.

The outwardly raised portion 32 includes a spherical domical portion 32B being raised toward an upper portion of a cylindrical truncated pedestal 32A. The domical portion 32B is located closer to the upper portion of the pedestal 32A (constricted side of the pedestal 32A). The outwardly raised portion 32 also includes a raised portion (inwardly raised portion) 36 being raised toward the inner surface (recessed side) of the domical portion 32B. A tip end of the raised portion 36 constitutes a contact 38. The raised portion 36 is located at substantially central portion of the domical portion 32B.

In other words, the outwardly raised portion 32 is provided at its substantially central portion with the raised portion 36 being raised toward the inner surface of the outwardly raised portion 32 (pedestal side, and recessed side of the domical portion 18) to constitute the contact 38.

Next, a case where an external force is applied to the key switch 1 in the positive direction of the Z-axis will be explained using FIGS. 5(A) and 5(B). The positive direction means a direction approaching the base plate 6 or the reference surface PL. If the substantially central portion of the key switch 1 is pressed toward the base plate 6, the key switch diaphragm 30 is elastically deformed (the domical portion 32B and the domical portion 18 of the key switch diaphragm 30 are mainly elastically deformed). The contact 34 and contact 38 of the key switch diaphragm 30 come into contact with the wiring pattern 4 of the base plate 6. As shown in FIG. 5(B), the contact portion is formed of an annular contact surface C21, and a circular contact surface C22 formed on an inside substantially central portion of the contact surface C21.

The domical portion 18 and the pedestal 16 function as a first leaf spring having a toggle mechanism which has two states, i.e., a stable state shown in FIG. 4A and a balanced state shown in FIG. 5(A) under an external force (in the Z-axis normal direction) is applied. An upwardly raised portion 32 functions as a second leaf spring. The edge 34 functions as a contact which connects these two leaf springs.

Thus, the key switch diaphragm 30 of this embodiment also includes first leaf springs 18 having the base 16 and the plate portion 18, and a second leaf spring 32 connected to the plate portion 18 through the contact 34. An outer edge 17 of the plate portion 18 is fixed relative to the reference surface PL by the base 16.

In the key switch diaphragm according to the invention, the first leaf spring and the second leaf spring are not limited to concentric elliptic disc springs shown in FIG. 4A, only if one cross section thereof is a leaf spring shown in FIGS. 4B and 5(A). That is, the present invention is applied to a diaphragm having such a cross section that both ends (outer edges) 17 and 17 of the plate portion 18 are fixed relative to the reference surface PL by the bases 16 and 16, and the second leaf spring 32 is fixed to the first leaf springs 18 and 18 by the edges 34 and 34. For example, if the diaphragm comprises a ribbon-like leaf spring, the contact pattern C21 of the edge 34 is not annular in shape, and there exist two contact patterns C21 substantially located at two separate symmetric positions with respect to the contact pattern C22.

When the key switch 1 is not pressed, the contact 38 of the key switch diaphragm 30 is located at the same level as or slightly higher than the contact 34. That is, the distance from the reference surface PL is substantially the same as the contact 34 or the contact 38 is slightly separated from the contact 34 with respect to the reference surface PL. Thus, when the key switch 1 is pressed, the domical portion 18 which is the first leaf spring and the domical portion 32B which is the second leaf spring are appropriately elastically deformed, and both the contact 34 and contact 38 come into contact with the wiring pattern 4 (substantially simultaneously for example). With this structure, it is possible to avoid a case where the click feeling is abruptly changed halfway when the key switch 1 is pressed.

If the contact and the wiring pattern contact with each other, the wiring pattern 2 and the wiring pattern 4 of the base plate 6 are electrically connected to each other. If the external force is not applied to the key switch diaphragm 30 in the direction of the wiring pattern 4 (positive direction of Z-axis), the state shown in FIG. 5(A) becomes unstable, the pressed position is released, and the key switch diaphragm 30 is returned to its initial position (stable state) before the key switch diaphragm 30 is elastically deformed. As a result, the contact 34 and contact 38 of the key switch diaphragm 30 are separated from the wiring pattern 4 of the base plate 6, and the electric connection between the wiring pattern 2 and the wiring pattern 4 of the base plate 6 is cut off.

According to the key switch 1, which comprises the key switch diaphragm 30, the edge which connects the domical portion 18 and the upwardly raised portion 32 with each other function as the ring-like contact 34 which surrounds the contact 38. Thus, when the key switch 1 is pressed, the edge contact 34 comes into contact with the wiring pattern 4. As a result, even if dust enters into the space surrounded by the key switch diaphragm 30 and the base plate 6 or adhesive droplets or resin droplets adheres to a portion of the contact 34, the contact 34 and the wiring pattern 4 can reliably contact with each other. Thus, the contact failure caused when the key switch 1 is pressed can be avoided.

It is preferable that the outer diameter of the outwardly raised portion 32 is 20% of the outer diameter of the 30% or more, and 2.5 mm or less. With this size, the edge 34 functions as electric contact, stresses around the edge of the outwardly raised portion 32 are effectively dispersed, and the durability is also enhanced.

Since the contact 38 also comes into contact with the wiring pattern 4 together with the contact 34, the contact failure caused when the key switch 1 is pressed can further be avoided. When the key switch 1 is pressed, if the raised portion 36 provided on the substantially central portion of the outwardly raised portion 32 comes into contact with the wiring pattern 4, the spherical domical portion 32B of the outwardly raised portion 32 as the second leaf spring is not deformed further. As a result, the domical portion 32B does not receive excessive stresses, and the durability of the key switch diaphragm 30 can be enhanced.

The outwardly raised portion 32 provided on the substantially central portion of the domical portion 18 of the key switch diaphragm 30 being raised outward of the domical portion 18, i.e., in a direction separating from the wiring pattern 4 with respect to the domical portion 18 (negative direction of Z-axis). Thus, even if the height of the pedestal 16 is not so high, large stroke can be secured like the conventional key switch 100 when the key switch 1 is pressed, and a good click feeling can be obtained. Since it is not necessary that the height of the pedestal 16 is high, residual stresses generated in the key switch diaphragm 30 when the key switch diaphragm 30 is pressed can be suppressed low, and the durability of the key switch diaphragm 30 can be enhanced.

When the key switch 1 is pressed, the substantially central portion of the key switch diaphragm 30 comes into contact with the wiring pattern 4 of the base plate 6. Therefore, eccentric stresses are not generated in the key switch diaphragm 30, stresses generated in the key switch diaphragm 30 can equally dispersed. Thus, durability against repeatedly pressing and release of pressing of the key switch diaphragm 30 can be enhanced.

As compared with the conventional key switch 400, the key switch 1 includes the raised portion 32 and the edge 34 of first leaf springs, in addition to the domical portion 18 of the first leaf spring provided at its central portion with the through hole. Thus, since stresses generated at peripheral edge of the hole are not concentrated, the durability of the key switch 1 is enhanced. In the key switch diaphragm 30, the raised portion 36 provided on the substantially central portion of the domical portion 32B may be omitted.

Since the raised portion 32 is raised in a direction separating away from the wiring pattern 4 (negative direction of Z-axis) with respect to the domical portion 18, the cover film 10 is elastically deformed at this portion, tension is increased, the pressure against the raised portion 32 is also increased and thus, the force of the cover film 10 applied to the key switch 1 for adhering and holding that can be increased.

Second Embodiment

Figure 6:
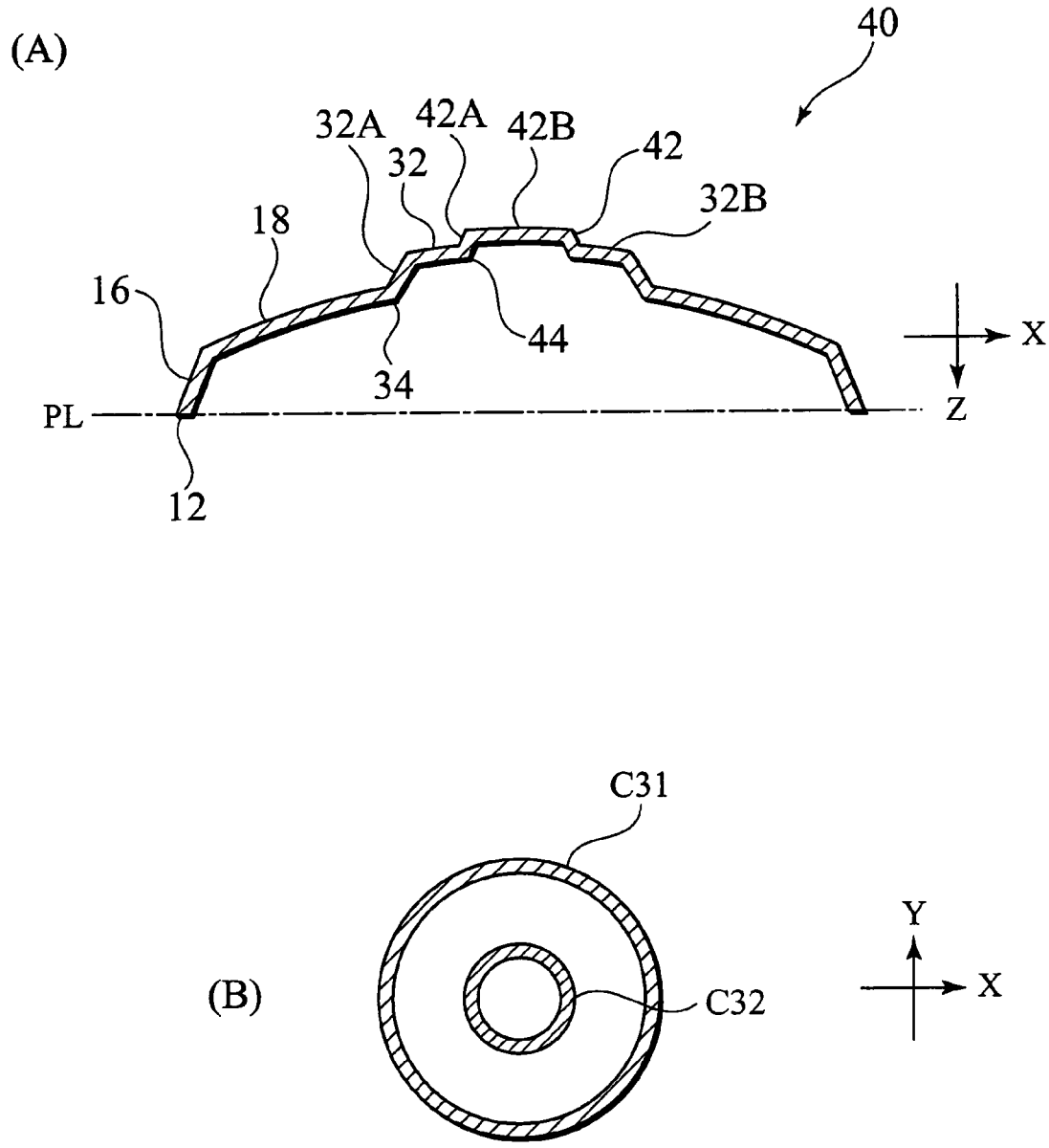
FIG. 6(A) is a schematic structure diagram of a key switch diaphragm constituting a key switch according to a second embodiment of the invention.
FIG. 6(B) is a diagram showing a contact surface pattern when the key switch shown in FIG. 6(A) is pressed.

FIGS. 6(A) and 6(B) show an outline structure of a key switch diaphragm 40 constituting a key switch according to a second embodiment of the present invention. In the key switch diaphragm 40, the domical portion 32B of the outwardly raised portion 32 is provide at its substantially central portion with an outwardly raised portion 42, instead of the raised portion 36 of the first embodiment provided at the substantially central portion of the domical portion 32B of the outwardly raised portion 32. Other elements of the key switch diaphragm 40 are structured substantially the same as that of the key switch diaphragm 30.

That is, the key switch diaphragm 40 includes the outwardly raised portion 42 provided at the substantially central portion of the domical portion 32B of the outwardly raised portion 32. An inner surface side (recessed side) edge of the domical portion 32B functions as a contact 44. The outwardly raised portion 42 is raised such as to separate from the reference surface PL toward the outer surface side (projecting side) of the domical portion 32B. The outwardly raised portion 42 is provided at its upper side (constricted side of a pedestal 42A) of the truncated pedestal 42A with a spherical domical portion 42B being raised toward an upper portion of the pedestal 42A. Thus, the outwardly raised portion 42 functions as a third leaf spring formed on the outwardly raised portion 32 which functions as the second leaf spring.

In other words, the substantially central portion of the outwardly raised portion 32 is provided with the outwardly raised portion 42 being raised toward an outer surface (opposite from the pedestal 16) of the outwardly raised portion 32. The edge (boundary with respect to the outwardly raised portion 32) of the inner surface side (on the side of the pedestal 16) of the outwardly raised portion 32 functions as an annular contact 44.

If the substantially central portion of the key switch constituted by the key switch diaphragm 40 is pressed, the key switch diaphragm 40 is elastically deformed, and the contacts 34 and 44 of the key switch diaphragm 40 comes into contact with the wiring pattern 4 of the base plate 6. As shown in FIG. 6(B), the contact portion is formed of an annular contact surface C31 and an annular contact surface C32 formed on the inner substantially central portion of the contact surface. With this contact, the wiring patterns 2 and 4 of the base plate 6 are electrically connected to each other through the key switch diaphragm 40.

The key switch constituted by the key switch diaphragm 40 functions substantially in the same manner as the key switch 1 of the first embodiment and can obtain substantially the same effect. Unlike the key switch 1, the contact 44 is formed in the form of an edge. Thus, even if dust enters the space surrounded by the base plate 6 and the key switch diaphragm 40, the contact 44 can easily contact with the wiring pattern 4 in addition to the contact 34, and contact failure when the key switch is pressed can further be avoided.

Third Embodiment

Figure 7:
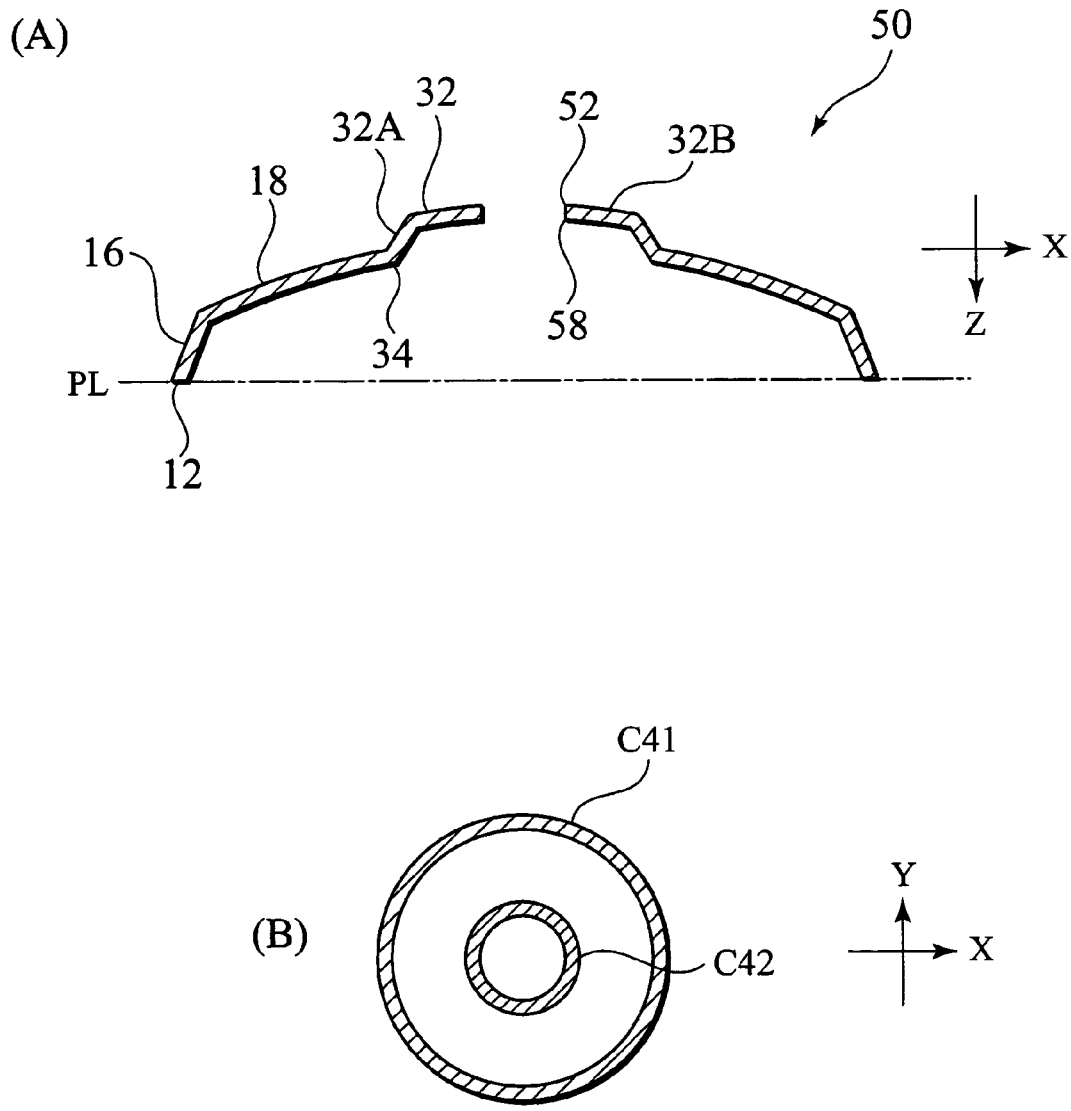
FIG. 7(A) is a schematic structure diagram of a key switch diaphragm constituting a key switch according to a third embodiment of the invention.
FIG. 7(B) is a diagram showing a contact surface pattern when the key switch shown in FIG. 7(A) is pressed.

FIGS. 7(A) and 7(B) show an outline structure of a key switch diaphragm 50 constituting a key switch according to a third embodiment of the present invention. The key switch diaphragm 50 is different from the key switch diaphragm 30 of the first embodiment in that the substantially central portion of the domical portion 32B of the outwardly raised portion 32 is provided with a through hole 52 instead of the raised portion 36. Other elements of the key switch diaphragm 40 are structured substantially the same as that of the key switch diaphragm 30. In other words, the outwardly raised portion 32 is provided at its substantially central portion with the through hole 52. A contact 58 is formed on an edge of an inner surface side (on the side of the pedestal 16) of the through hole 52.

If the substantially central portion of the key switch constituted by the key switch diaphragm 50 is pressed, the key switch diaphragm 50 is elastically deformed, and the contact 34 of the key switch diaphragm 50 and the contact 58 formed from the edge of the inner surface side (recessed side of the domical portion 32B) of the through hole 52 come into contact with the wiring pattern 4 of the base plate 6. As shown in FIG. 7(B), the contact portion is formed from an annular contact surface C41 and an annular contact surface C42 formed at an inner substantially central portion of this contact surface C41.

The key switch having the key switch diaphragm 50 functions substantially in the same manner as the key switch 1 of the first embodiment and can obtain substantially the same effect. Unlike the key switch 1, the contact 58 is formed in the form of an edge. Thus, even if dust enters the space surrounded by the base plate 6 and the key switch diaphragm 50, the contact 58 can easily contact with the wiring pattern 4 in addition to the contact 34, and contact failure when the key switch is pressed can further be avoided.

According to the key switch using the key switch diaphragm 30 or the key switch diaphragm 50, since there exists no raised portion on the outer side (side separating away from the base plate 6) of the domical portion 32B of the outwardly raised portion 32, the height of the key switch diaphragm 30 or the key switch diaphragm 50 becomes smaller than that of the key switch diaphragm 40, and since the height of the key switch is suppressed, the key switch can be reduced in size.

As compared with the conventional key switch 400, the key switch 50 includes the through hole in the central portion, like the conventional key switch 400, but the through hole (opening) 52 of the key switch diaphragm 50 is formed above the second leaf spring 32 which is an elastic element independent from the first leaf spring 18. Thus, the contact pattern of the key switch diaphragm 50 is constituted by the two annular patterns C41 and C42 as shown in FIG. 7(B) and the stresses are appropriately dispersed. Therefore, since stresses generated in the peripheral edge of the opening 52 are not concentrated, the durability of the key switch 1 is enhanced.

Fourth Embodiment

Figure 8A:
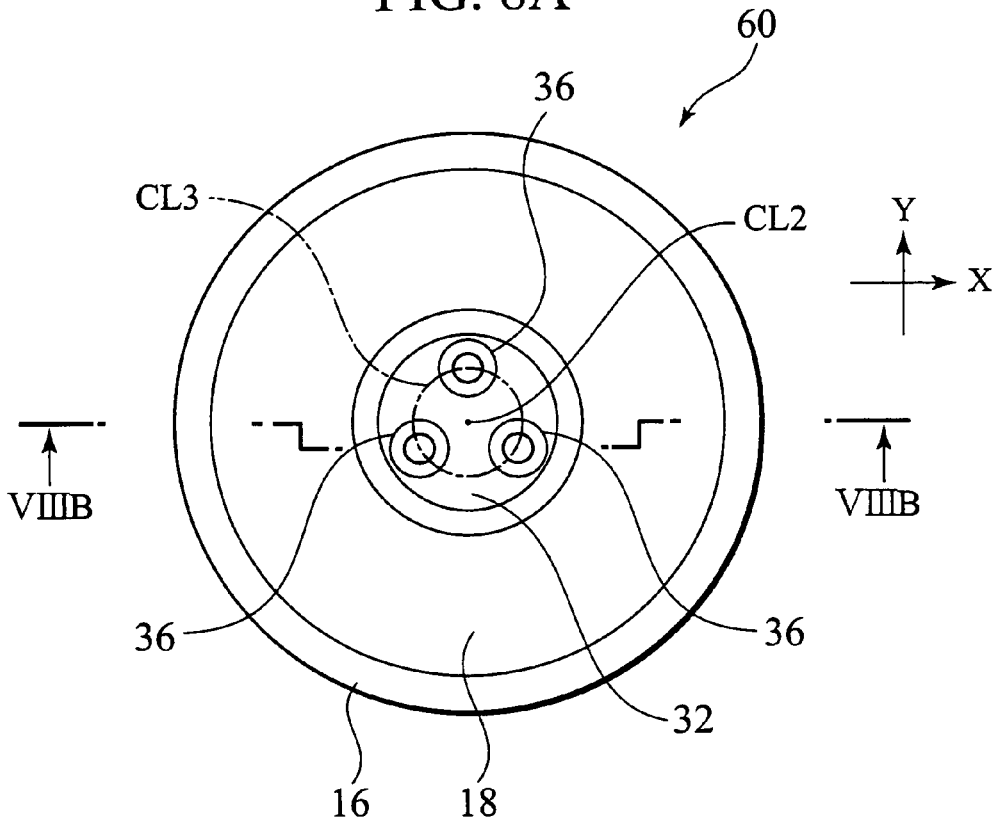
FIG. 8A is a schematic structure diagram of a key switch diaphragm constituting a key switch according to a fourth embodiment of the invention.
Figure 8B:
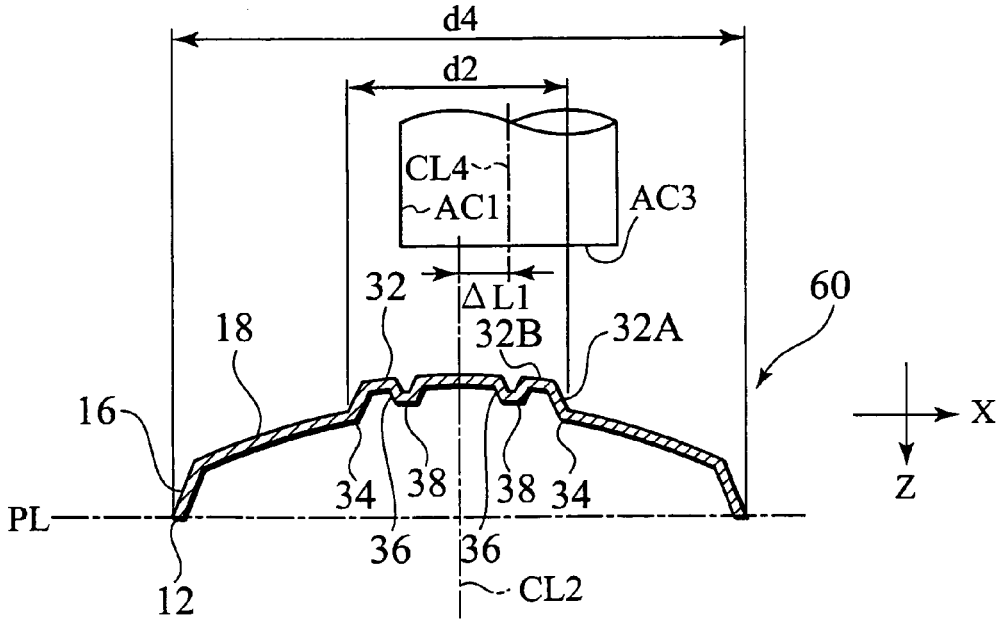
FIG. 8B is a sectional view taken along the line VIII B—VIII B in FIG. 8A.

FIGS. 8A and 8B show an outline structure of a key switch diaphragm 60 constituting a key switch according to a fourth embodiment of the present invention. FIG. 8A is a plan view of the key switch diaphragm 60, and FIG. 8B is a sectional view taken along the line VIII B—VIII B in FIG. 8A.

The key switch diaphragm 60 is different from the key switch diaphragm 30 of the first embodiment in that the domical portion 32B of the outwardly raised portion 32 is provided with a plurality of (three, for example) raised portions 36 at locations except the key switch diaphragm 60 and the center CL2 of the outwardly raised portion 32. Other structure is substantially the same as that of the key switch diaphragm 30.

That is, the key switch diaphragm 60 includes the raised portions 36 being raised from the inner surface side (on the side of the pedestal 16) of the outwardly raised portion 32 as the second leaf spring to constitute the contact 38. Each raised portion 36 is disposed on the circumference of a circle CL3 formed around the center CL2 of the key switch diaphragm 60. In this embodiment, the number of raised portions 36 is three, and they are disposed at locations equally divided on the circumference.

According to the key switch diaphragm of this embodiment, in addition to the characteristics described in the first to the third embodiments, the following effects can be obtained. As shown in FIGS. 8A and 8B, since the outwardly raised portion 32 is provided with the plurality of raised portions 36, the deformation stresses of the domical portion 32B of the outwardly raised portion 32 are increased. When an external force from an upper surface is applied to the key switch diaphragm 60, the surface of the domical portion 32B is not deformed almost at all, and operation by the deformation of the domical portion 18 is carried out. That is, if an external force is applied to the key switch diaphragm 60 at a location displaced by ΔL1 as shown in FIG. 8B, since the deformation of the domical portion 18 is generated before the outwardly raised portion 32 is deformed, the original click feeling of the key switch diaphragm 60 is not deteriorated almost at all if the displacement caused by the external force is in a range of the domical portion 32B of the outwardly raised portion 32, and a stable click feeling can be obtained.

Key Switch

A key switch constituted using the key switch diaphragm according to the present invention will be explained. The key switch includes a base plate (not shown) which comes into contact with an edge (contact 12) of the key switch diaphragm 60. The key switch diaphragm 60 is placed on one of surfaces of the base plate. The key switch also includes a press member (actuator) AC1, which is movably fixed in position in a direction intersecting the reference surface PL (for example, the direction of orthogonal Z direction) toward the key switch diaphragm 60, and which applies an external force to the key switch diaphragm 60 toward the reference surface PL. The press member AC1 presses the key switch diaphragm 60 through a sheet-like support member (not shown) such as an elastic material provided on a front surface of the key switch. More specifically, the key switch includes a flat contact AC3 on one end side (end facing the diaphragm 60) of the press member AC1. The contact AC3 moves and comes into contact with the diaphragm 60, and applies the external force toward the reference surface PL (positive direction of Z-axis).

In a normal position (in a state where an external force is not applied to the diaphragm 60), the contact 34 of the outwardly raised portion 32 of the key switch diaphragm 60 is separated from the base plate and the key switch diaphragm 60 is maintained in its stable state. If the press member AC1 presses, the external force is applied to the key switch diaphragm 60 and is elastically deformed, and the contact 34 of the outwardly raised portion 32 of the key switch diaphragm 60 comes into contact with the base plate (or reference surface). Each contact 38 of the outwardly raised portion 32 also comes into contact with the base plate (or reference surface).

A first electric wire (first conductor pattern) being provided on one of the surfaces of the base plate and functioning as a contact, and a second electric wire (second conductor pattern) which is electrically connected to the pedestal 16 are disposed on the base plate such that they are electrically isolated. In the normal position, the first electric wire and the second electric wire are left isolated. If the press member AC1 pressed the key switch diaphragm 60, the contact 34 or the contact 38 of the central portion of the key switch diaphragm 60 comes into contact with the first electric wire of the base plate, and the first electric wire and the second electric wire are electrically conducted with each other through the key switch diaphragm 60.

The key switch using the key switch diaphragm 60 of the fourth embodiment of the present invention is explained above. And it is apparent that the above explanation can also be applied to key switches using other key switch diaphragms 30, 40, and 50. According to the key switch having the key switch diaphragm 60, the same effect as that of the key switch 1 of the first embodiment can be obtained.

According to the key switch constituted using the key switch diaphragm 60, even if the key switch 1 is pressed in a position where the center of the actuator AC1 is deviated from the center of the key switch diaphragm 60 by ΔL1, since the domical portion 18 is deformed before the outwardly raised portion 32 is deformed, the original click feeling of the key switch diaphragm 60 is not deteriorated (deterioration of click rate) almost at all if the deviation value ΔL1 is in a range of the domical portion 32B of the outwardly raised portion 32, and a stable click feeling can be obtained. That is, since the outwardly raised portion 32 is an elastic element (second leaf spring) independent from the domical portion 18 and the like, if an external force is applied to any position of the outwardly raised portion 32, the outwardly raised portion 32 is moved and deformed as a whole, the external force can equally be distributed to the domical portion 18. As a result, a stable click feeling can be obtained even if the displacement ΔL1 is generated. Thus, a person skilled in the art will easily understand that even if other key switch diaphragm 30, 40, or 50 of the first, the second, or the third embodiment is used, the same effect can be obtained.

Figure 9:
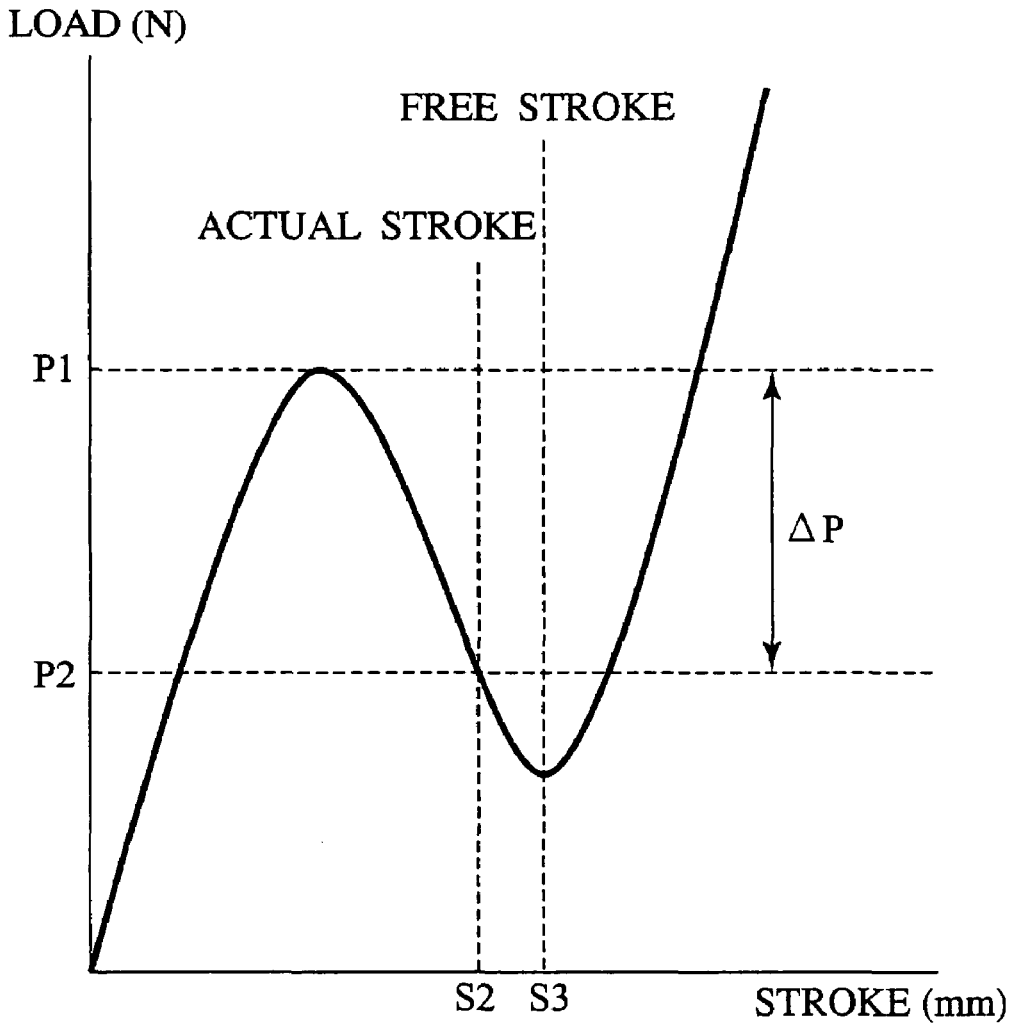
FIG. 9 is an explanatory view of a click rate.
Figure 10:
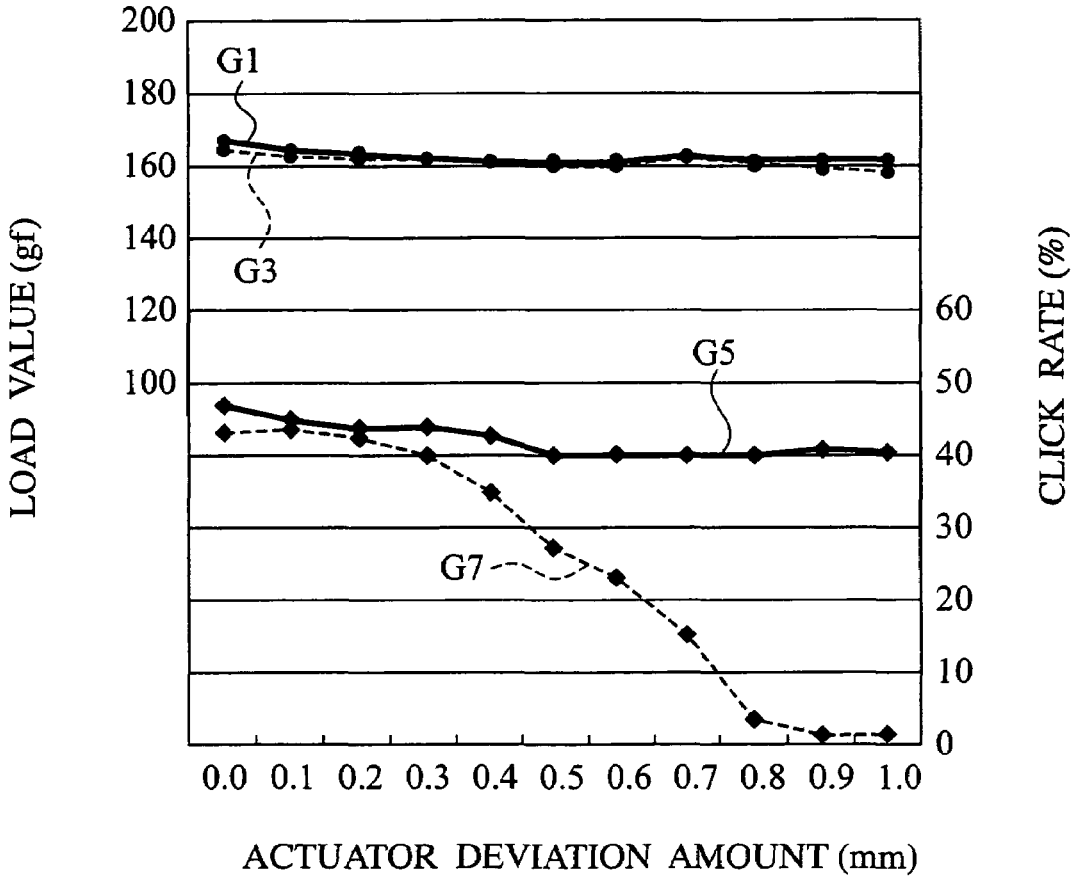
FIG. 10 is a graph showing a relation between an actuator displacement amount and a click rate of the key switch diaphragm, and a relation between the actuator displacement amount and a displacement load value of the key switch diaphragm.

Next, a measurement result of the click feeling (click rate) when the actuator is deviated in position will be explained. FIG. 9 is a graph for explaining the click rate. FIG. 10 is a graph showing a relationship between a deviation of an actuator position and a click rate of the key switch diaphragm, and a relationship between the deviation of the actuator position and a displacement load value of the key switch diaphragm.

The click rate means one of indices for objectively showing the quality of the click feeling. As the click rate value is smaller, the click feeling is generally deteriorated more. A lateral axis in FIG. 9 shows a displacement amount (stroke) in the moving direction (Z-axis direction in FIG. 8B) when the key switch diaphragm is pressed, and this amount is more increased as the key switch diaphragm approaches closer to the reference surface PL. A vertical axis shown in FIG. 9 indicates a load when the key switch diaphragm is pressed.

That is, if a pressing operation of the key switch diaphragm is initiated from the normal position (external force is not applied to the diaphragm), the load is gradually increased from "0", and reaches the maximum value P1. If the key switch diaphragm is further pressed, the load assumes the minimum value and then, the value is increased. Thus, the key switch diaphragm has a contact structure utilizing a toggle mechanism.

In a case where the key switch diaphragm constitutes the key switch placed on the base plate, the contact of the central portion of the key switch diaphragm comes into contact with the conductor (first electric wire) located at the reference surface PL when the stroke amount is a stroke amount S2 before reaching a stroke amount S3. If the load at that time is defined as P2, the click rate η is expressed as $\eta(\%)=100\times(P1-P2)/P1$.

A lateral axis in FIG. 10 shows the deviation of the displacement amount ΔL1, and a vertical axis in FIG. 10 shows the maximum load P1 and the click rate. In the graph shown in FIG. 10, G1 shows the maximum value load P1 of the key switch diaphragm 60, and G3 shows the maximum value load P1 of the conventional key switch diaphragm 102C (see FIG. 3(B)). Furthermore, G5 in FIG. 10 shows the click rate of the key switch diaphragm 60, and G7 shows the click rate of the conventional key switch diaphragm 102C. As shown in FIG. 10, the maximum value loads are almost the same between the key switch diaphragm 60 and the conventional key switch diaphragm 106C, and the value is substantially constant (160gf=1.57 N) irrespective of the deviation of the actuator position as the displacement between the center of the key switch diaphragm and the center of the actuator.

On the other hand, in the key switch diaphragm 60, the value is substantially constant (about 40%) irrespective of the center CL2 of the key switch diaphragm 60 and the center CL4 of the actuator AC1, but in the conventional key switch diaphragm 102C, the value is gradually reduced as the displacement amount between the center of the key switch diaphragm and the center of the actuator is increased, and when the deviation reaches 0.8 mm, the click rate is reduced to about "0".

The outer diameter d4 of the key switch diaphragm 60 shown in FIG. 8B is 5 mm, the outer diameter d2 of the outwardly raised portion 32 is 2 mm, and the outer diameter of the conventional key switch diaphragm 102C is also 5 mm. The outer diameter of the actuator AC1 is 2 mm.

Key switches are constituted using the various key switch diaphragms, the key switches are pressed and released, and ON/OFF operation of the key switches are repeated. As a result, the volume and pressure in the space surrounded by the key switch diaphragm and the base plate on which the key switch diaphragm is place are varied, and air and fine dust may enter the surrounded space from a narrow gap between the base plate and the outer edge of the key switch diaphragm in some cases.

As described above, there is a strong tendency that the fine dust interferes with air which enters the surrounded space from narrow gaps formed substantially uniformly along the entire outer periphery of the key switch diaphragm, and the dust is converged to the central portion of the key switch diaphragm and accumulated thereon.

According to the key switch constituted by the key switch diaphragm 60, since the raised portions 36 constituting the contacts 38 are disposed on the inner surface side of the outwardly raised portion 32 on the circumference of the circle formed around the key switch diaphragm 60. In other words, the central portion of the key switch diaphragm 60 is not formed with the contact 38. Therefore, a contact failure occurring with the fine dust converted to and accumulated on the central portion of the key switch diaphragm 60 and by repeated using of the key switch can be suppressed as low as possible.

Furthermore, according to the key switch having the key switch diaphragm 60, the raised portions 36 constituting the contacts 38 are disposed on the inner surface side of the outwardly raised portion 32 at locations equally divided into three on the circumference of a circle CL3 formed around the center CL2 of the outwardly raised portion 32. That is, the raised portions 36 are disposed in well balance such that when the key switch diaphragm 60 is suppressed, the contacts 38 on the tip ends of the raised portions 36 and the edge contact 34 of the outwardly raised portion 32 define one flat surface. Thus, even if the key switch diaphragm is pressed in a direction which is not perpendicular to the base plate surface (reference surface PL) but in a direction slightly deviated from the direction perpendicular (the Z-axis), any one of the contacts of the key switch diaphragm easily comes into contact with the conductor located on the reference surface.

Thus, according to the key switch using the key switch diaphragm 60, even if the key switch is pressed slightly obliquely, the contact failure of the contact of the key switch can be suppressed.

Although it is possible that the number of raised portions constituting the contacts on the inner surface side of the outwardly raised portion 32 may be four or more, the structure of the key switch diaphragm becomes complicated. Furthermore, internal stresses of the key switch diaphragm may be increased. Thus, if the number of raised portions constituting the contacts is set to three, the structure of the key switch diaphragm is simplified, and contact failure of the key switch using the key switch diaphragm can be reduced as small as possible.

Figure 1A:
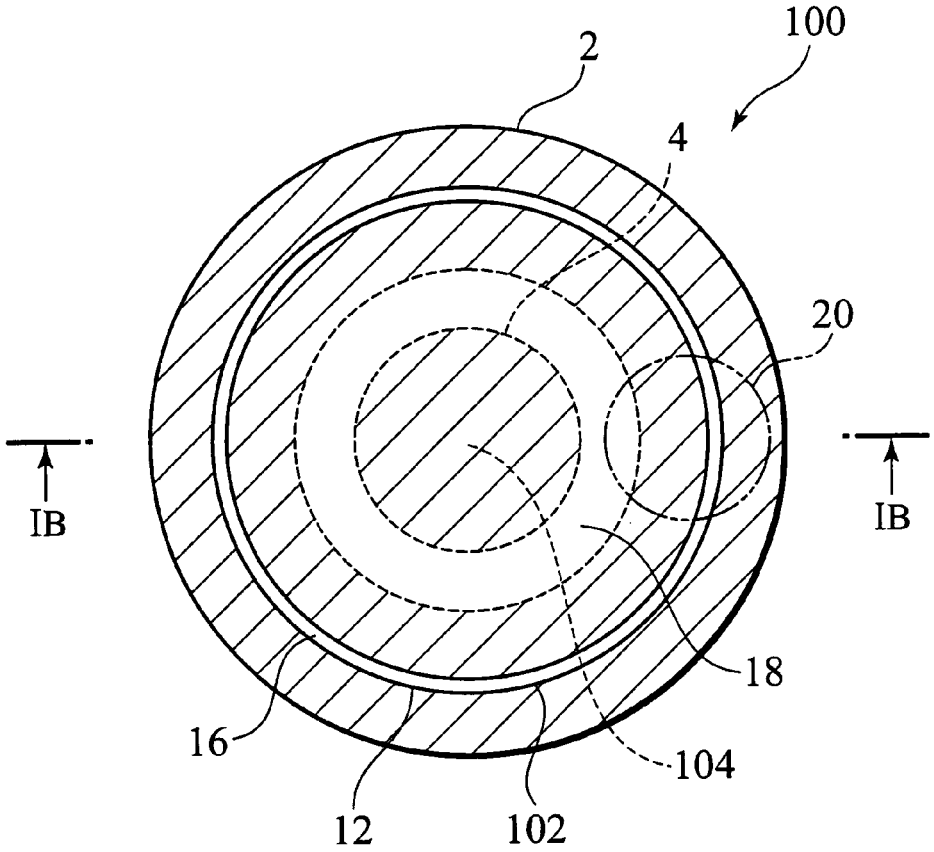
FIG. 1A PRIOR ART
FIG. 1A is a schematic structure diagram of a first conventional key switch.
Figure 1B:
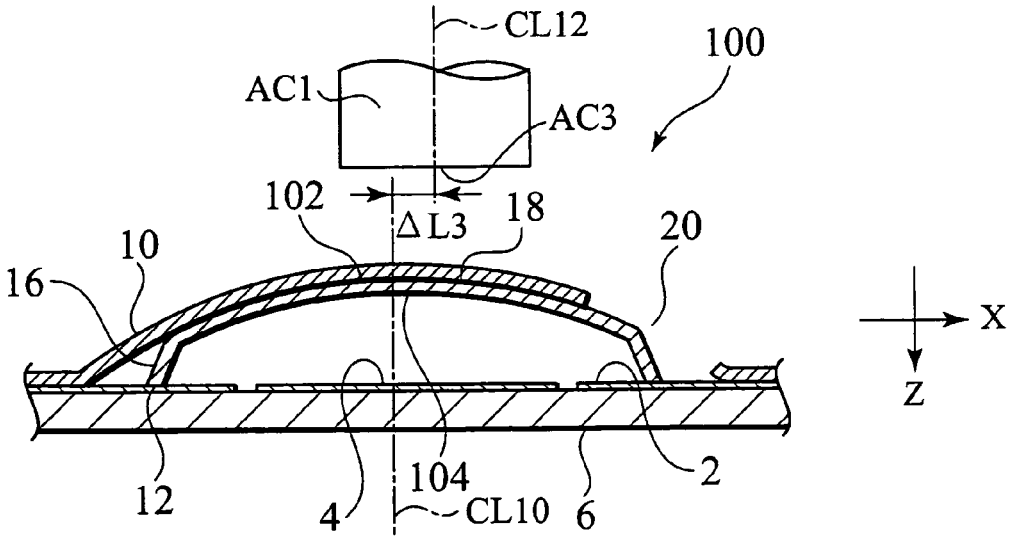
FIG. 1B PRIOR ART
FIG. 1B is a sectional view taken along the line IB—IB in FIG. 1A.
Figure 2:
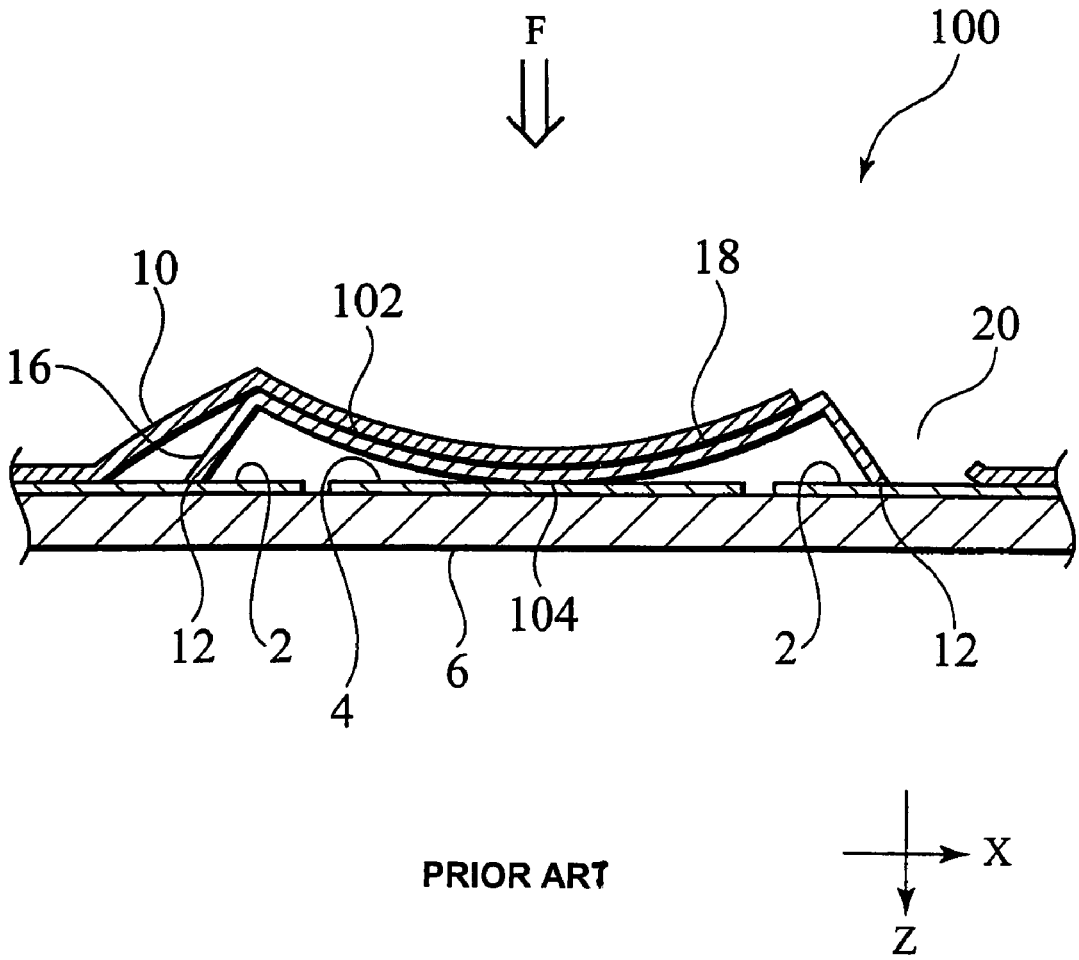
FIG. 2 is a diagram showing a state where the first conventional key switch is pressed.
Figure 3:
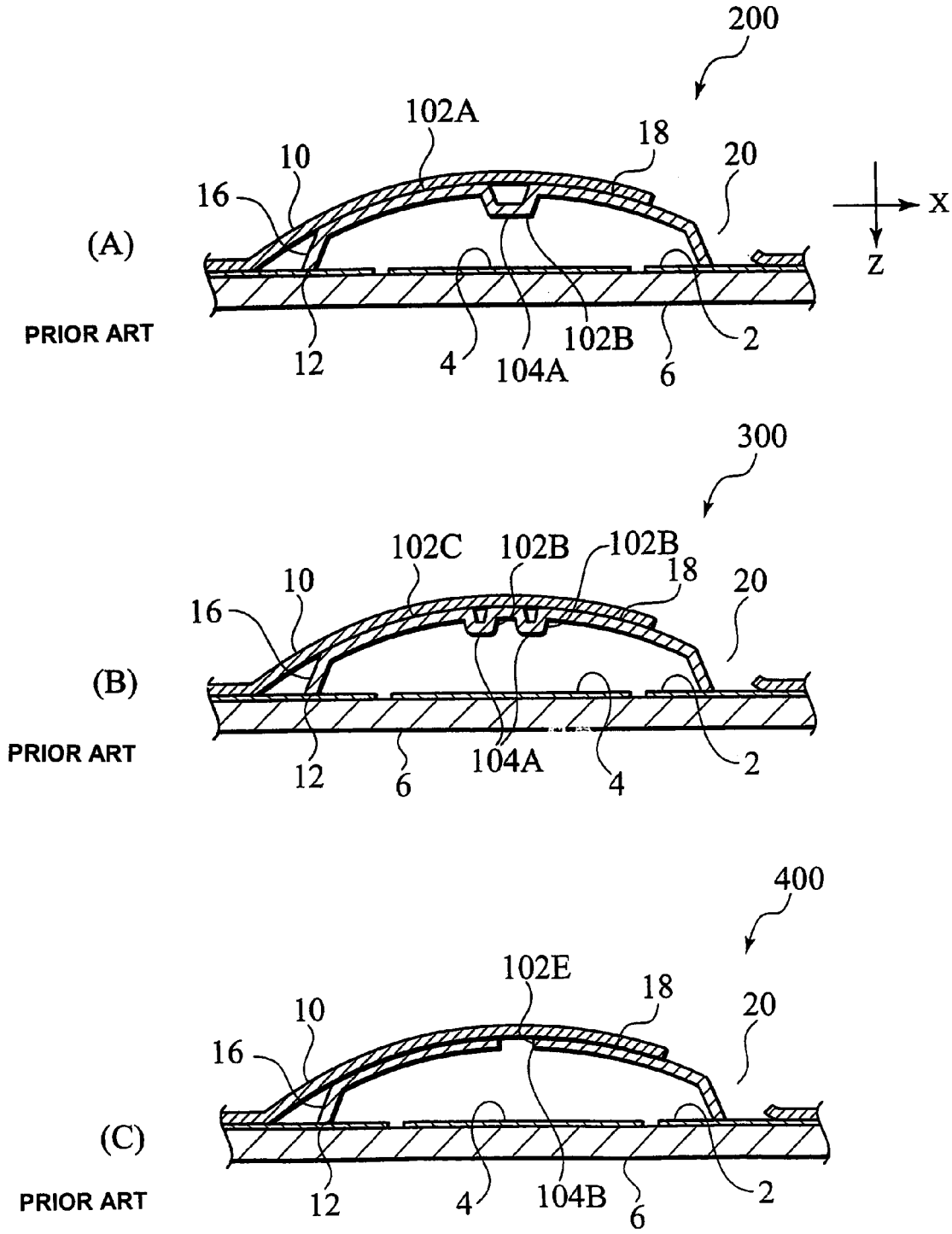
FIG. 3(A) is a schematic structure diagram of a second conventional key switch.
FIG. 3(B) is a schematic structure diagram of a third conventional key switch.
FIG. 3(C) is a schematic structure diagram of a fourth conventional key switch.

Next, comparison of lifetime of the key switch diaphragm according to the present invention and lifetime of the conventional key switch diaphragm 102C (see FIG. 3(B)) will be explained. A lifetime test was carried out with respect to ten samples of key switch diaphragm 60 (type I), ten samples having no raised portion 36 on the key switch diaphragm 60 (type II), and ten samples of the conventional key switch diaphragm 102C (type III). The type having no raised portion 36 corresponds to the key switch diaphragm having the second leaf spring and is one of the typical embodiments of the present invention. To ensure the same click feeling, the distance between the raised portion and the reference surface was set equally.

In the test, a key switch was pressed two million times under the load of 320 gf (3.1 N) at frequency of three to five times per second. As a result of the pressings, a crack or abnormal restoration (left dented) was generated in all of the conventional key switch diaphragms 102C. In the key switch diaphragm of the second conductor pattern of the type of this invention, no crack or no abnormal restoration was generated, and six samples had 30% variation amount of the maximum value load P1, and four samples had 30% to 40% variation amount. In the key switch diaphragm 60 of the type having the raised portions, no crack or no abnormal restoration was generated, and all samples had the variation amount of 30% of the maximum value load P1 shown in FIG. 9 and thus, no abnormality before and after the test in the restoration load was generated. Therefore, it becomes apparent that the lifetime of the key switch diaphragm according to the invention is enhanced. It becomes apparent that the lifetime is enhanced of the raised portion is provided.

It is conceived that the reason why the lifetime of the key switch diaphragm according to the present invention is enhanced is that since the first leaf spring is provided at its central portion with the second leaf spring, the contacts 34 are not located at a point but are annularly distributed toward the reference surface PL, and since the load is shared between the plurality of bent portions 17, 34, and 35 as shown in FIG. 4B and thus stresses are appropriately dispersed, and elasticity of each leaf spring is maintained. A reason why the lifetime of the key switch diaphragm 60 having the raised portions is long is that when the same pressing stroke as that of the conventional key switch diaphragm 102C is to be obtained, since the outwardly raised portion 32 is provided with the raised portions 36, the pedestal which generates large internal stresses at the time of production can be made lower. Thus, the magnitude of the internal stresses generated when it is produces is smaller in the key switch diaphragm 60. Furthermore, it is conceived that since the raised portions 36 function as stoppers which limit the deformation amount (Z direction) of the diaphragm 60 irrespective of the magnitude of the external force applied to the diaphragm 60, excessive stresses to the first leaf spring or the second leaf spring are limited and thus, the lifetime is enhanced.

According to the present invention as described above, there is an effect that the key switch diaphragm capable of obtaining a good click feeling when a switch is pressed, capable of avoiding contact failure, and having a high durability.

The nvention claimed is:

1. A key switch diaphragm comprising:

a first leaf spring having conductivity, having a base fixed relative to a reference surface and having a plate portion raised in a direction away from the reference surface;

a second leaf spring having conductivity, being formed on a central portion of the plate portion raised in a direction away from the reference surface; and at least one raised portion being raised toward the reference surface, wherein when an external force acting toward the reference surface is applied to the second leaf spring, an edge of the central portion comes into contact with the reference surface and at least the raised portion comes into contact with the reference surface.

2. The key switch diaphragm according to claim 1, wherein the first leaf spring has an angle cross section in a theoretical plane intersecting the reference surface.

3. The key switch diaphragm according to claim 1, wherein the first leaf spring and the second leaf spring are disc springs.

4. The key switch diaphragm according to claim 1, wherein the raised portion is raised in three parts, and the raised parts are disposed at locations other than the center of the second leaf spring.

5. The key switch diaphragm according to claim 4, wherein the raised parts are disposed at equal distances from one another on the circumference of a circle formed around a center of the second leaf spring.

6. A key switch comprising:

the diaphragm according to any one of claims 1 to 5;

a base plate on which a base of the diaphragm is placed and which defines the reference surface and defines a conductor which is electrically insulated from the base; and an actuator which applies an external force acting toward the reference surface to the diaphragm and which is fixed relative to the base plate in position such that the actuator can move in a direction intersecting the reference surface.

7. A key switch diaphragm comprising:

a first leaf spring having conductivity, having a base fixed relative to a reference surface and having a plate portion raised in a direction away from the reference surface;

a second leaf spring having conductivity, being formed on a central portion of the plate portion raised in a direction away from the reference surface; and a third leaf spring formed on the second leaf spring raised in a direction away from the reference surface, wherein when an external force acting toward the reference surface is applied to the third leaf spring, an edge of at least the third leaf spring comes into contact with the reference surface.

8. A key switch diaphragm comprising:

a first leaf spring having conductivity, having a base fixed relative to a reference surface and having a plate portion raised in a direction away from the reference surface;

a second leaf spring having conductivity, being formed on a central portion of the plate portion raised in a direction away from the reference surface; and an opening formed in the second leaf spring, wherein when an external force acting toward the reference surface is applied to the second leaf spring, an edge of at least the opening comes into contact with the reference surface.

* * * * *